US006224333B1

(12) United States Patent
Loeffler et al.

(10) Patent No.: US 6,224,333 B1
(45) Date of Patent: May 1, 2001

(54) EXHAUST GAS TURBOCHARGER FOR AN INTERNAL-COMBUSTION ENGINE

(75) Inventors: Paul Loeffler, Stuttgart; Erwin Schmidt, Baltmannsweiler; Siegfried Sumser, Stuttgart, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/248,272

(22) Filed: Feb. 11, 1999

(30) Foreign Application Priority Data

Feb. 11, 1998 (DE) ..... 198 05 476

(51) Int. Cl.[7] ..... F01D 17/16

(52) U.S. Cl. ..... 415/158; 60/602; 29/889.1; 29/889.2

(58) Field of Search ..... 415/157, 158, 415/167, 214.1, 915; 60/602; 417/47, 407; 29/889.1, 889.2

(56) References Cited

U.S. PATENT DOCUMENTS

| | | | | |
|---|---|---|---|---|
| 2,784,675 | * | 3/1957 | Farrell | 415/214.1 |
| 2,861,774 | * | 11/1958 | Buchi | 415/158 |
| 3,303,998 | * | 2/1967 | Koff et al. | 415/214.1 |
| 4,265,589 | * | 5/1981 | Watson et al. | 415/158 |
| 4,582,466 | * | 4/1986 | Szczupak | 415/158 |
| 4,886,416 | * | 12/1989 | Wunderlich | 415/158 |
| 5,941,684 | * | 8/1999 | Parker | 415/158 |

FOREIGN PATENT DOCUMENTS

| | | | | |
|---|---|---|---|---|
| 668 455 | | 12/1988 | (CH) . | |
| 4303521 | * | 5/1994 | (DE) | 415/158 |
| 43 30 487 | | 1/1995 | (DE) . | |
| 195 43 190 | | 5/1997 | (DE) . | |
| 0 034 915 | | 9/1981 | (EP) . | |
| 227475 | * | 7/1987 | (EP) | 60/602 |
| 487193 | * | 5/1992 | (EP) | 415/214.1 |
| 0 654 587 | | 5/1995 | (EP) . | |
| 624777 | * | 11/1989 | (GB) | 415/214.1 |
| 89/11583 | * | 11/1989 | (WO) | 415/158 |

OTHER PUBLICATIONS

European Search Report for EP 99100678.4, dated Jul. 14, 1999.

* cited by examiner

*Primary Examiner*—Christopher Verdier
(74) *Attorney, Agent, or Firm*—Evenson, McKeown, Edwards & Lenahan, P.L.L.C.

(57) ABSTRACT

An exhaust gas turbocharger for an internal-combustion engine has a turbine wheel which is arranged in a housing of the exhaust gas turbocharger and to which exhaust gas can be fed by way of a flow duct constructed in the housing. A variable baffle is provided for adjusting the flow cross-section of the flow duct. In order to equip the exhaust gas turbocharger with a braking function at low manufacturing and mounting expenditures, the baffle is movably accommodated in a matrix which is detachably held on the housing. The baffle and the matrix form an exchangeable braking module.

15 Claims, 2 Drawing Sheets

EXHAUST GAS TURBOCHARGER FOR AN INTERNAL-COMBUSTION ENGINE

BACKGROUND OF THE INVENTION

The present invention relates to an exhaust gas turbocharger for an internal-combustion, and more particularly, to a turbocharger having a turbine wheel which is arranged in the housing of the exhaust gas turbocharger and to which exhaust gas can be fed by way of a flow duct constructed in the housing, and having a variable baffle for adjusting a flow cross-section of the flow duct.

DE 195 43 190 A1 discloses an internal-combustion engine which has an exhaust gas turbocharger with a variable turbine geometry. On a housing of the turbine of the turbocharger, an adjustable baffle is arranged which has guide blades between which flow ducts for the exhaust gas are constructed. A control element provides adjustment of the guide blades between an opening position with the lowest possible reduction of the flow cross-section of a flow duct feeding exhaust gas and a ram position with the highest possible reduction of the flow cross-section. In order to obtain a high braking effect during the braking operation of the internal-combustion engine, the baffle is changed to its ram position, whereupon an excess pressure builds up in the section between the cylinders and the exhaust gas turbocharger. The brake pressure results in a rise of air flow in the cylinder and counteracts the compression of the gas in the cylinder.

Simultaneously, exhaust gas flows at a high velocity through the flow ducts between the guide blades and acts upon the turbine wheel whose power is transmitted to the compressor which builds up an excess pressure in the intake system and feeds it to the cylinder.

The cylinder is therefore acted upon with an increased charging pressure on the input side. A quasi-static excess pressure exists on the output side between the cylinder outlet and the exhaust gas turbocharger. This excess pressure counteracts the blowing-off of the air compressed in the cylinder into the exhaust gas piping. In the braking operation, the piston must therefore carry out compression work during the compression stroke against the high excess pressure in the exhaust gas piping, whereby a strong braking effect is achieved.

DE 43 30 487 C1 also shows a turbine with a variable turbine geometry. The turbine has a radial and a semiaxial ring nozzle. A stationary baffle is arranged in the semiaxial ring nozzle, and a variable baffle with rotatable guide blades is arranged in the radial ring nozzle. In addition, a ring, which is contoured in a fluidically advantageous manner, is arranged on the stationary baffle, is situated between the semiaxial and the radial ring nozzle and forms a stationary non-adjustable component of the turbine.

SUMMARY OF THE INVENTION

An object of the present invention is to equip exhaust gas turbochargers with a braking function at low manufacturing and mounting expenditures. In particular, it is to be possible with the present invention to retrofit existing exhaust gas turbochargers with a braking function.

According to the present invention, the foregoing objects have been achieved by providing that the baffle is movably accommodated in a matrix, the baffle and the matrix form a ring-shaped exchangeable braking module, and the matrix is detachably held on the housing and surrounds an outer contour of the turbine wheel by means of a defined gap.

By combining the components determining the braking function to form a braking module, the present invention makes it possible to provide new exhaust gas turbochargers as well as exhaust gas turbochargers which have been in operation with a braking function. The engine braking performance and the performance characteristics of the engine brake can be influenced by a simple exchange of the braking module.

Furthermore, the present invention also makes it possible to exchange within a module only the baffle and the matrix in which the baffle is guided in order to obtain in this manner an adaptation of the braking module to the respective geometry of the turbine wheel. As the result of the adaptation of certain components of the braking module to the geometry of differently constructed exhaust gas turbochargers, the braking module can be used for various exhaust gas turbochargers with only a few modifications.

The engine braking performance is achieved by the blocking or reduction of the flow cross-section by the adjustable baffle. An engine brake flap arranged behind the turbine is, however, not required and would even have a disturbing effect, which provides more mounting space.

The baffle can be advantageously axially adjusted between the opening position and the ram position so that, for changing into the ram position, the baffle must only be moved axially into the flow duct. The axially adjustable baffle is distinguished by a simple kinematic handling.

The baffle and the matrix are arranged in a ring shape around the turbine wheel in order to be able to block the ring nozzle of the normally spiral-shaped flow duct by way of which the exhaust gas can be fed from the exhaust gas piping of the turbine and in order to be able to build up the ram pressure required for the engine brake. In this embodiment, the guide blades are arranged in a ring and are preferably held on a carrier ring which provides an axial guidance in the matrix and can be acted upon by suitable control elements in the direction of the opening position or the ram position.

The carrier ring preferably has an approximately U-shaped cross-section which has a high stability and, in addition, may extend along the matrix as well as along the opposite wall in the housing of the exhaust gas turbocharger. The wall of the carrier ring to which the guide blades are fastened may have compensating bores in order to reduce or avoid an air cushion between this wall and the housing of the exhaust gas turbocharger. The air cushion would otherwise affect the adjusting movement during the axial adjusting of the baffle.

A removable lid is preferably provided on the housing so that the braking module, particularly the matrix, can be clamped to the housing and can be removed as required. For a secure receiving of the braking module, anchoring devices are provided for detachably fastening the matrix to the housing.

The baffle and/or the matrix can be constructed as a precision casting or as a sintered part which meets high precision requirements and is well suitable for being machined.

BRIEF DESCRIPTION OF THE DRAWINGS

Other objects, advantages and novel features of the present invention will become apparent from the following detailed description of the invention when considered in conjunction with the accompanying drawings wherein.

DETAILED DESCRIPTION OF THE DRAWINGS

Figure 1:
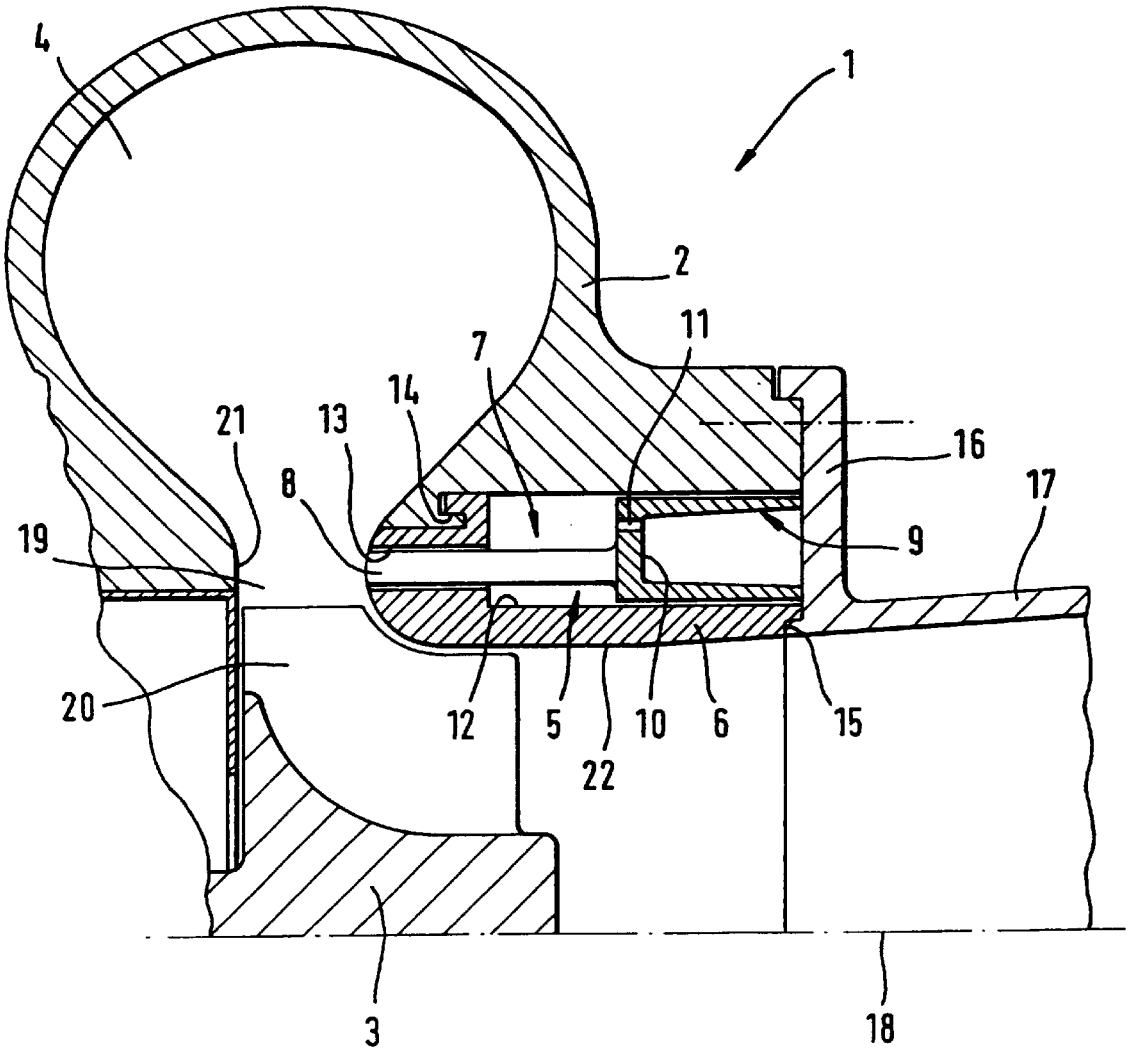
FIG. 1 is a sectional view of the turbine of an exhaust gas turbocharger.

The exhaust gas turbocharger 1 in an internal-combustion engine, particularly in the internal-combustion engine of a utility vehicle, comprises a turbine which is arranged in a housing 2 and has a variable turbine geometry. A turbine wheel 3 is disposed to be rotatable about an axis of rotation 18 and is driven by the exhaust gas of the internal-combustion engine. The turbine wheel 3 is coupled with a known compressor (not shown), which is arranged in the intake system of the internal-combustion engine to compress the intake air.

The exhaust gas is fed to the turbine wheel 3 by way of a flow duct 4 which is arranged in the housing 2 and having the shape of a spiral exhaust gas flow. The radially interior section of the flow duct 4 forms a ring duct 19 of a diameter which tapers with respect to the flow duct 4, resulting in a nozzle effect. The exhaust gas flows from the spiral-shaped flow duct 4 by way of the ring duct 19 to the blades 20 of the turbine wheel 3 to rotate turbine wheel 3. The relaxed exhaust gas is discharged by way of an outlet diffuser from the exhaust gas turbocharger 1.

In the exhaust gas turbocharger 1, a braking module 7 is arranged for reducing the free flow cross-section of the ring duct 19 so that the flow of the exhaust gas from the flow duct 4 to the blades 20 is impaired. An excess pressure builds up in the pipe section of the exhaust gas piping between the cylinders and the exhaust gas turbochargers and counteracts the piston movement during the compression stroke in the braking operation of the internal-combustion engine.

The braking module 7 includes a baffle 5 which can be adjusted between an opening position opening up the flow cross-section of the ring duct 19 and a ram position reducing the flow cross-section, and a matrix 6 on which the baffle 5 is disposed in an axially movable manner. The matrix 6 and the baffle 5 have a virtually rotationally symmetrical construction, with the rotation axis 18 of the turbine wheel simultaneously almost forming the axis of symmetry of the braking module.

The baffle 5 has a plurality of profiled guide blades 8 which are arranged in a ring shape and are fastened to a carrier ring 9 which can have a U-shaped cross-section and is slidably disposed on the radially exterior side 12 of the matrix 6. The carrier ring 9 of the baffle can be axially acted upon by known types of control-and-adjusting devices (not shown), so that the baffle 5 is changed from the illustrated opening position into the ram position in which the guide blades 8 project into the flow cross-section of the ring duct 19. The guide blades 8 can be displaced advantageously into the ring duct 19 to such an extent that the face of the guide blades 8 rests against the interior wall 21 of the ring duct 19.

On the side adjacent the ring duct 19, the matrix 8 contains passages 13 through which the guide blades 8 are guided. A small gap is advantageously formed between the guide blades 8 and the wall of the passages 13 in order to take into account thermal expansions of the guide blades 8 and permit an unhindered axial adjustment. Supporting struts of the matrix 6 can extend in the passages 13 between two adjacent guide blades respectively.

The guide blades 8 are fastened to a wall 10 of the carrier ring 9, in which case compensating bores 11 are provided in the wall 10 in order to permit, particularly during the adjusting from the opening position into the ram position, an escape of the gas in the space between the wall 10 and the matrix 6 and in order to prevent a resistance against the adjusting movement. In addition, a pressure compensation is obtained so that the adjusting forces remain low.

The radially interior wall 22 of the matrix 6 forms a contour in the transition between the wall of the flow duct 4 and the outlet diffuser 17. A wheel gap is situated between the blades 20 of the turbine wheel 3 and the matrix 6 in order to take into account thermal expansions and to avoid damage to the blades 20.

In order to detachably mount the braking module 7 on the exhaust gas turbocharger, but simultaneously position it in a reliable manner and mount it in an operationally secure manner, the braking module 7 is clamped in by a lid 16 which expediently forms a one-piece component with the outlet diffuser 17. Furthermore, anchoring devices 14, 15 are provided on the matrix 6 by way of which the braking module is held on the housing 2. A first anchoring device 14 in the form of a groove-shaped recess is provided on the side of the matrix 6 facing the flow duct 4. A projection of the housing 2 engages in this recess. An additional anchoring device 15 is arranged on the axially opposite side in the radially interior section of the matrix 6. The anchoring device 15 is constructed as a surrounding step into which a projection of the lid 16 engages.

The baffle and/or the matrix can be constructed as a precision casting or as a sintered part which meets high precision requirements.

Figure 2:
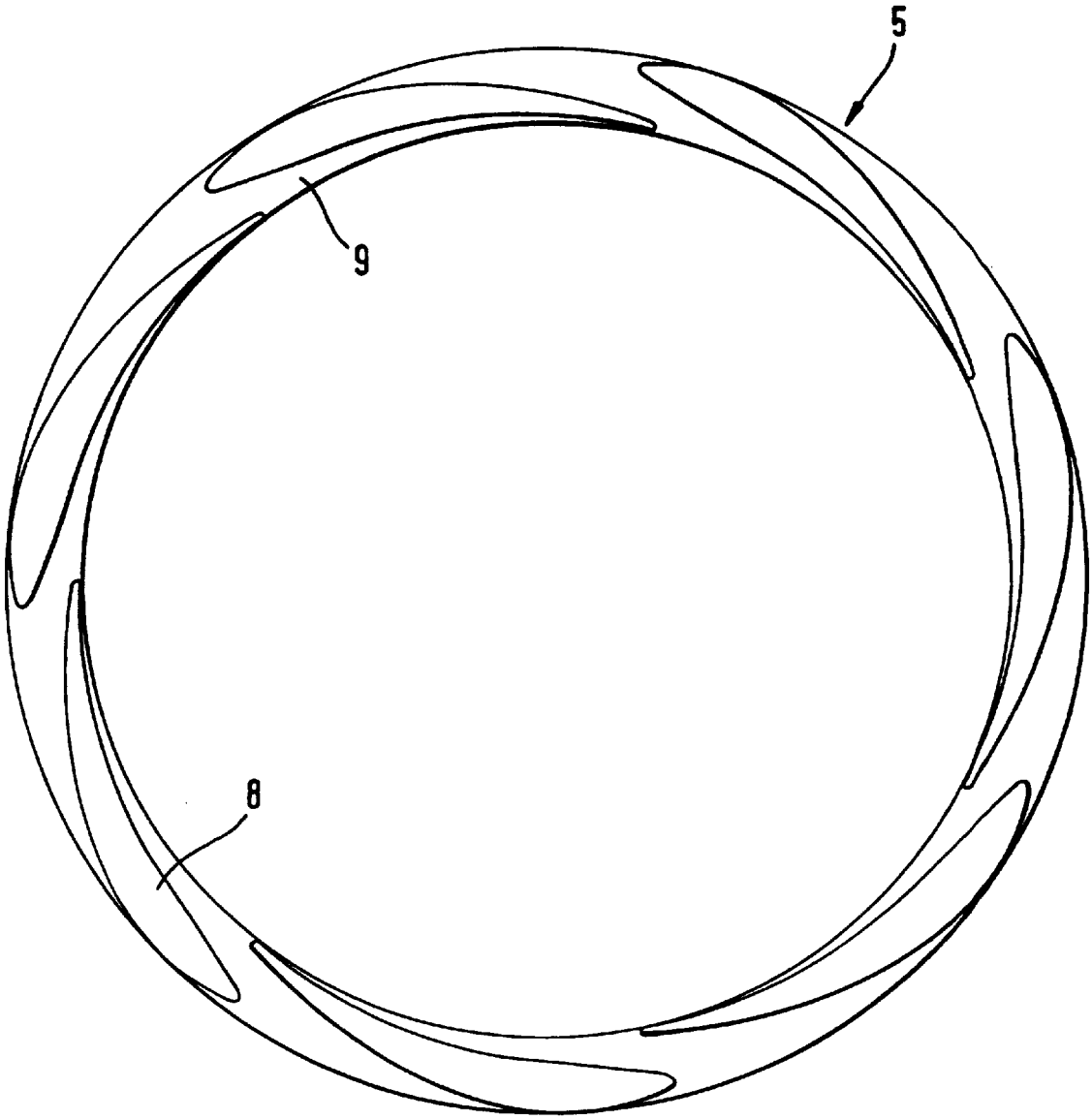
FIG. 2 is a view of the face of a baffle shown in FIG. 1.

According to FIG. 2, a total of seven guide blades 8 are arranged in a uniformly distributed manner along the circumference of the baffle 5 and are fastened to the carrier ring 9. The guide blades 8 have a fluidically optimized construction in accordance with known design considerations. Between two adjacent guide blades 8 respectively, passages are provided for the exhaust gas so that a portion of the retained exhaust gas can pass the baffle 5 and meets the blades of the turbine wheel at a high velocity. The turbine wheel drives the compressor, whereupon air in the intake duct is delivered in a pressurized manner into the cylinders for increasing the air volume.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An exhaust gas turbocharger for an internal-combustion engine, comprising a housing, a turbine wheel operatively arranged in the housing so as to have exhaust gas fed thereto by way of a flow duct constructed in the housing, and a matrix having a variable baffle movably accommodated therein for adjusting a flow cross-section of the flow duct, wherein the baffle and the matrix form a ring-shaped exchangeable braking module to provide retrofitability or exchange for influencing output characteristics of the turbocharger, with the matrix being detachably held on the housing and surrounding an outer contour of the turbine wheel with a defined gap between the matrix and the outer contour, and narrow passages for the baffle are provided in the matrix so a to have opposed faces adjacent each side of the baffle.

2. The exhaust gas turbocharger according to claim 1, wherein the baffle is axially adjustable.

3. The exhaust gas turbocharger according to claim 1, wherein the baffle has several guide blades which form a ring and which are arranged on a carrier ring assigned to the baffle.

4. The exhaust gas turbocharger according to claim 2, wherein the baffle has several guide blades which form a ring and which are arranged on a carrier ring assigned to the baffle.

5. The exhaust gas turbocharger according to claim 3, wherein the carrier ring has an approximately U-shaped cross-section.

6. The exhaust gas turbocharger according to claim 3, wherein pressure compensating bores are provided in a wall of the carrier ring facing the guide blades.

7. The exhaust gas turbocharger according to claim 5, wherein pressure compensating bores are provided in a wall of the carrier ring facing the guide blades.

8. The exhaust gas turbocharger according to claim 1, wherein the baffle is adjustably arranged on a radially exterior side of the matrix.

9. The exhaust gas turbocharger according to claim 1, wherein anchoring devices for fastening the braking module at the housing are arranged on the matrix.

10. The exhaust gas turbocharger according to claim 1, wherein a removable lid is provided on the housing for clamping the matrix at the housing.

11. The exhaust gas turbocharger according to claim 10, wherein the lid forms a one-piece component with an outlet diffuser discharging the exhaust gas.

12. The exhaust gas turbocharger according to claim 1, wherein at least one of the baffle and the matrix is a precision casting.

13. The exhaust gas turbocharger according to claim 1, wherein at least one of the baffle and the matrix is a sintered part.

14. A method of constructing an exhaust gas turbocharger, comprising arranging a turbine wheel in a housing such that a flow duct in the housing feeds exhaust gas to the turbine wheel;

providing a plurality of matrixes with respective movable variable baffles to form ring-shaped braking modules to obtain different turbocharger operating characteristics, said matrixes being provided with narrow passages having opposed faces adjacent each side of the baffles; and removably attaching a selected one of the brake modules on the housing to surround an outer contour of the turbine wheel.

15. A method of retrofitting an existing exhaust gas turbocharger with a ring-shaped braking module, comprising installing the braking module with a matrix and a movable variable baffle so as to surround an outer contour of a turbine wheel arranged in a turbocharger housing having a flow duct, with narrow passages provided in the matrix and having opposed faces adjacent each side of the baffle and to allow exhaust gas to be fed to the turbine wheel from the flow duct; and arranging the braking module such that the variable baffle is able to adjust a flow cross-section of the flow duct.

* * * * *